US010837710B2

(12) United States Patent
Mohammadian et al.

(10) Patent No.: US 10,837,710 B2
(45) Date of Patent: Nov. 17, 2020

(54) PLATE HEAT EXCHANGER

(71) Applicant: ALFA LAVAL CORPORATE AB, Lund (SE)

(72) Inventors: Mehrdad Mohammadian, Helsingborg (SE); Kerstin Drakarve, Dalby (SE)

(73) Assignee: ALFA LAVAL CORPORATE AB, Lund (SE)

( * ) Notice: Subject to any disclaimer, the term of this patent is extended or adjusted under 35 U.S.C. 154(b) by 15 days.

(21) Appl. No.: 16/097,454

(22) PCT Filed: May 18, 2017

(86) PCT No.: PCT/EP2017/062012
§ 371 (c)(1),
(2) Date: Oct. 29, 2018

(87) PCT Pub. No.: WO2017/207292
PCT Pub. Date: Dec. 7, 2017

(65) Prior Publication Data

US 2019/0145711 A1 May 16, 2019

(30) Foreign Application Priority Data

May 30, 2016 (SE) ..... 1650749

(51) Int. Cl.
*F28F 19/02* (2006.01)
*F28D 9/00* (2006.01)
(Continued)

(52) U.S. Cl.
CPC ..... *F28D 9/005* (2013.01); *F28F 3/086* (2013.01); *F28F 9/026* (2013.01); *F28F 9/0273* (2013.01); *F28D 2021/0064* (2013.01)

(58) Field of Classification Search
CPC .. F28D 9/005; F28D 2021/0064; F28F 3/086; F28F 9/026; F28F 9/0273
(Continued)

(56) References Cited

U.S. PATENT DOCUMENTS 2,392,444 A * 1/1946 Amand ..... F28F 9/00 165/150
2,550,339 A * 4/1951 Ehrman ..... F28F 3/083 165/167
(Continued)

FOREIGN PATENT DOCUMENTS

CN 1902456 A 1/2007
CN 101476829 A 7/2009
(Continued)

OTHER PUBLICATIONS

International Search Report (PCT/ISA/210) dated Sep. 11, 2017, by the European Patent Office as the International Searching Authority for International Application No. PCT/EP2017/062012.
(Continued)

*Primary Examiner* — Claire E Rojohn, III
(74) *Attorney, Agent, or Firm* — Buchanan Ingersoll & Rooney PC

(57) ABSTRACT

A plate heat exchanger comprises first heat exchanger plates, second heat exchanger plates, first plate interspaces each formed by a primary pair of one second heat exchanger plate and an adjacent first heat exchanger plate, and second plate interspaces each formed by a secondary pair one first heat exchanger plate and an adjacent second heat exchanger plates. Each first heat exchanger plate comprises a peripheral rim surrounding a first porthole and defining an inlet channel for a first fluid through the plate heat exchanger. Each secondary pair encloses an inlet chamber adjacent to the peripheral rim. The inlet chamber is closed to the second plate interspaces, open to the inlet channel and communi-
(Continued)

cates with one of the first plate interspaces via a nozzle member, thereby permitting a flow of the first fluid from the inlet channel to the first plate interspace.

19 Claims, 6 Drawing Sheets

(51) Int. Cl.
*F28F 3/08* (2006.01)
*F28F 9/02* (2006.01)
*F28D 21/00* (2006.01)

(58) Field of Classification Search
USPC ..... 165/134.1
See application file for complete search history.

(56) References Cited

U.S. PATENT DOCUMENTS 2,617,634 A * 11/1952 Jendrassik ..... F28D 9/0093 165/140
3,537,165 A * 11/1970 Kemp ..... F28D 9/0043 29/890.039
4,246,962 A * 1/1981 Norback ..... F24F 13/30 165/166
4,327,802 A * 5/1982 Beldam ..... F28D 1/0333 165/153
4,398,596 A * 8/1983 Lauro ..... B01D 1/221 165/136
4,660,633 A * 4/1987 Fischer ..... B21D 13/02 165/167
4,872,578 A * 10/1989 Fuerschbach ..... F28D 9/005 165/167
5,924,484 A * 7/1999 Andersson ..... F28F 3/083 165/167
5,931,219 A * 8/1999 Kull ..... F28D 9/005 165/166
5,971,065 A * 10/1999 Bertilson ..... F28F 9/026 165/153
6,161,615 A * 12/2000 Brieden ..... F28D 9/005 165/166
6,340,054 B1 * 1/2002 Schwarz ..... F01M 5/002 165/153
6,843,311 B2 * 1/2005 Evans ..... F28D 9/005 165/109.1
7,404,434 B2 * 7/2008 Martin ..... F28D 9/005 165/167
7,690,420 B2 * 4/2010 Horte ..... F28D 9/005 165/153
8,167,029 B2 5/2012 Bertilsson et al.
8,662,152 B2 * 3/2014 Arvidsson ..... F28D 9/005 165/167
9,453,690 B2 * 9/2016 Martin ..... F28D 1/0333
10,502,507 B2 * 12/2019 Sugama ..... F28F 19/06
2001/0030043 A1 * 10/2001 Gleisle ..... F28F 3/10 165/167
2002/0050347 A1 * 5/2002 Hainley ..... F28D 9/005 165/167
2005/0082049 A1 * 4/2005 Brost ..... F28D 9/005 165/166
2007/0245560 A1 * 10/2007 Matsuzaki ..... F28D 9/0037 29/890.039
2008/0196874 A1 * 8/2008 Bertilsson ..... F28F 9/026 165/167
2008/0257536 A1 * 10/2008 Kolblin ..... F28D 9/005 165/167
2008/0283231 A1 * 11/2008 Horte ..... F28F 9/0282 165/167
2009/0064579 A1 * 3/2009 Wakasugi ..... B01J 19/0093 48/76
2010/0036528 A1 * 2/2010 Minard ..... B67D 1/10 700/265
2011/0308779 A1 * 12/2011 Andersson ..... F28D 9/005 165/170
2015/0292803 A1 * 10/2015 Nyander ..... B23P 15/26 165/166
2015/0316330 A1 * 11/2015 Kenney ..... F28D 9/0056 165/167
2019/0033005 A1 * 1/2019 Romlund ..... C22C 19/056
2019/0145711 A1 * 5/2019 Mohammadian ..... F28F 9/026 165/134.1

FOREIGN PATENT DOCUMENTS

CN 101476830 A 7/2009
CN 101476831 A 7/2009
CN 102829655 A 12/2012
DE 10024888 A1 11/2001
EP 2730878 A1 5/2014
GB 134277 A 10/1919
JP 2001280888 A 10/2001
TW 201437593 A 10/2014
WO 2005066572 A1 7/2005
WO 2006110090 A1 10/2006
WO 2010069872 A1 6/2010
WO 2014072223 A1 5/2014

OTHER PUBLICATIONS

Written Opinion (PCT/ISA/237) dated Sep. 11, 2017, by the European Patent Office as the International Searching Authority for International Application No. PCT/EP2017/062012.

* cited by examiner

PLATE HEAT EXCHANGER

TECHNICAL FIELD OF THE INVENTION

The present invention refers to a plate heat exchanger for evaporation according to the preamble of claim 1.

BACKGROUND OF THE INVENTION AND PRIOR ART

EP-2 730 878 discloses a plate package of a plate heat exchanger. The plate package comprises first heat exchanger plates and second heat exchanger plates, which are arranged side by side in such a way that a first plate interspace is formed between each pair of adjacent first heat exchanger plates and second heat exchanger plates, and a second plate interspace between each pair of adjacent second heat exchanger plates and first heat exchanger plates. The first plate interspaces and the second plate interspaces are separated from each other and provided side by side in an alternating order in the plate package. Each of the first and second heat exchanger plates has a first porthole, surrounded by a peripheral rim. The first heat exchanger plates and the second heat exchanger plates are joined to each other via joints of braze material between the first and second heat exchanger plates and arranged in such a way that the peripheral rims together define an inlet channel extending through the plate package.

A restriction hole is provided through the peripheral rim of the first and/or the second heat exchanger plates and forms a fluid passage allowing a communication between the inlet channel and the first plate interspaces.

One problem related to the prior art plate heat exchanger is that the restriction hole is sensible to cracking. This sensibility is due to the relatively low height of the peripheral rim, which means that the restriction hole will be positioned relatively close to the edge of the peripheral rim. Consequently, there will be only a short distance between the restriction hole and the edge of the peripheral rim. This is in particular the case when the pressure depth of the heat exchanger plates is small.

SUMMARY OF THE INVENTION

The object of the present invention is to remedy the problems discussed above. In particular, it is aimed at a plate heat exchanger being less susceptible to cracks at the inlet channel, in particularly in the peripheral rim forming the inlet channel.

This object is achieved by the plate heat exchanger initially defined, which is characterized in that each of the secondary pairs encloses an inlet chamber adjacent to the peripheral rim, and that the inlet chamber is closed to the second plate interspaces, is open to the inlet channel and communicates with one of the first plate interspaces via at least one nozzle member, comprising one or more restrictions holes, thereby permitting a flow of the first fluid from the inlet channel to the first plate interspaces.

By locating the nozzle for the first fluid in the inlet chamber and not through the peripheral rim, cracking of the peripheral rim can be avoided. The nozzle member comprises one or more restriction holes. Such restriction hole may be made in advance, before the plate heat exchanger is assembled. The one or more restriction holes provide a restriction or throttling of the first fluid passing through the nozzle member. Such restriction or throttling ensures a proper distribution of the first fluid in the first plate interspace. The first fluid may thus flow from the inlet channel into the inlet chamber and then through the nozzle into the first plate interspaces.

According to an embodiment of the invention, the nozzle member extends through the first heat exchanger plate between the inlet chamber and said one of the first plate interspaces. The nozzle may thus be located at a distance from the peripheral rim so that the risk for cracks is avoided.

According to an embodiment of the invention, the number of restriction holes through the first heat exchanger plate may be one, two, three, four or even more.

According to an embodiment of the invention, the one or more restriction holes together have a flow area of 1.5-2.5 $mm^2$.

According to an embodiment of the invention, each of the inlet chambers is separated from the other inlet chambers of the plate heat exchanger.

According to an embodiment of the invention, the inlet chamber surrounds the inlet channel. The inlet chamber may thus be annular. The inlet chamber may alternatively extend along a part of the circumference of the inlet channel.

According to an embodiment of the invention, each of the first heat exchanger plates comprises an annular flat portion adjacent the peripheral rim. The annular flat portion and the peripheral rim may partly enclose the inlet chamber. The annular flat portion contributes to strengthen the region close to the peripheral rim.

According to an embodiment of the invention, the annular flat portion extends substantially in parallel with the extension plane.

According to an embodiment of the invention, the annular flat portion adjoins a corresponding annular flat portion of the second heat exchanger plate of an adjacent secondary pair. The joining of the annular flat portion to the corresponding annular flat portion secures a high strength of the plate heat exchanger around the inlet channel.

According to an embodiment of the invention, the peripheral rim of the first heat exchanger plate of the secondary pairs comprises a depression forming a surface portion extending away from the inlet channel, wherein an aperture extends through the surface portion and permits said flow of the first fluid from the inlet channel to the first plate interspace.

By providing an aperture through such a surface portion, the aperture may be located at a greater distance from an edge of the peripheral rim than if it is located directly on the peripheral rim. The aperture is thus less susceptible to create cracks in the peripheral rim. The first fluid may thus flow from the inlet channel into the depression and through the aperture through the surface, and then further into the first plate interspaces.

According to an embodiment of the invention, the depression extends from the annular surface and from the peripheral rim.

According to an embodiment of the invention, the surface portion is partly surrounded by a wall surface, which extends between and connects to the surface portion and the annular flat portion.

According to an embodiment of the invention, the surface portion is substantially plane.

According to an embodiment of the invention, the surface portion extends substantially in parallel with the extension plane.

According to an embodiment of the invention, the peripheral rim of the first heat exchanger plate of the secondary pairs comprises a recess extending from an edge of the peripheral rim, and permitting said flow of the first fluid from the inlet channel to the first plate interspaces.

Such a recess located at the edge of the peripheral rim is less susceptible to create cracks in the peripheral rim than a hole through the peripheral rim close to the edge. The first fluid may thus flow from the inlet channel through the recess into the inlet chamber and then further into the first plate interspace.

According to an embodiment of the invention, the peripheral rim has a rim height perpendicular to the extension plane from an edge to a root end of the peripheral rim, wherein the peripheral rim passes the adjacent second heat exchanger plate before reaching the adjacent first heat exchanger plate. The edge of the peripheral rim may thus be joined to the root end of the peripheral rim of the first heat exchanger plate of the adjacent secondary pair.

According to an embodiment of the invention, each of the first and second heat exchanger plates has a heat exchanger area comprising a corrugation of ridges and valleys, and wherein a pressure depth is defined between an upper point of the ridges and a lower point of the valleys on an upper side of the heat exchanger plate.

According to an embodiment of the invention, the pressure depth is less than 3 mm, preferably less than 2 mm.

According to an embodiment of the invention, each of the first and second heat exchanger plates comprises an edge area extending around the heat exchanger area.

According to any one of the preceding claims, wherein the first heat exchanger plates and the second heat exchanger plates are permanently joined to each other, preferably through brazing.

BRIEF DESCRIPTION OF THE DRAWINGS

The present invention is now to be explained more closely through a description of various embodiments and with reference to the drawings attached hereto.

DETAILED DESCRIPTION OF VARIOUS EMBODIMENTS

Figure 1:
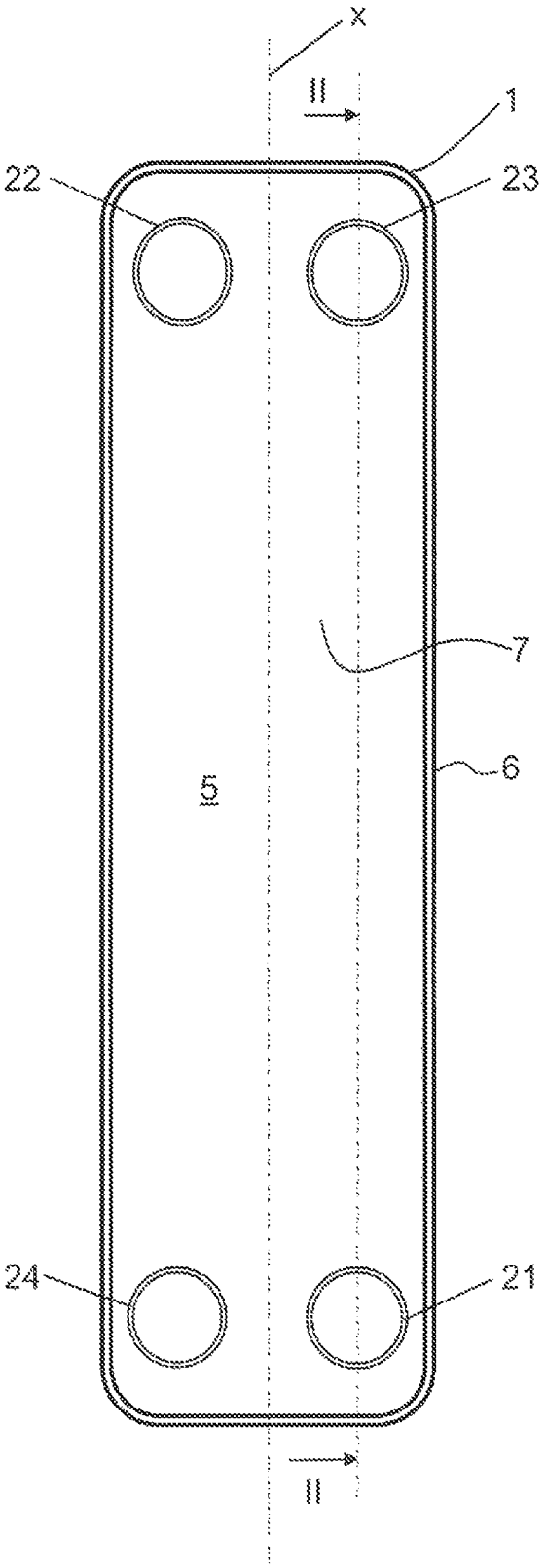
FIG. 1 discloses schematically a plan view of a plate heat exchanger according to a first embodiment of the invention.
Figure 2:
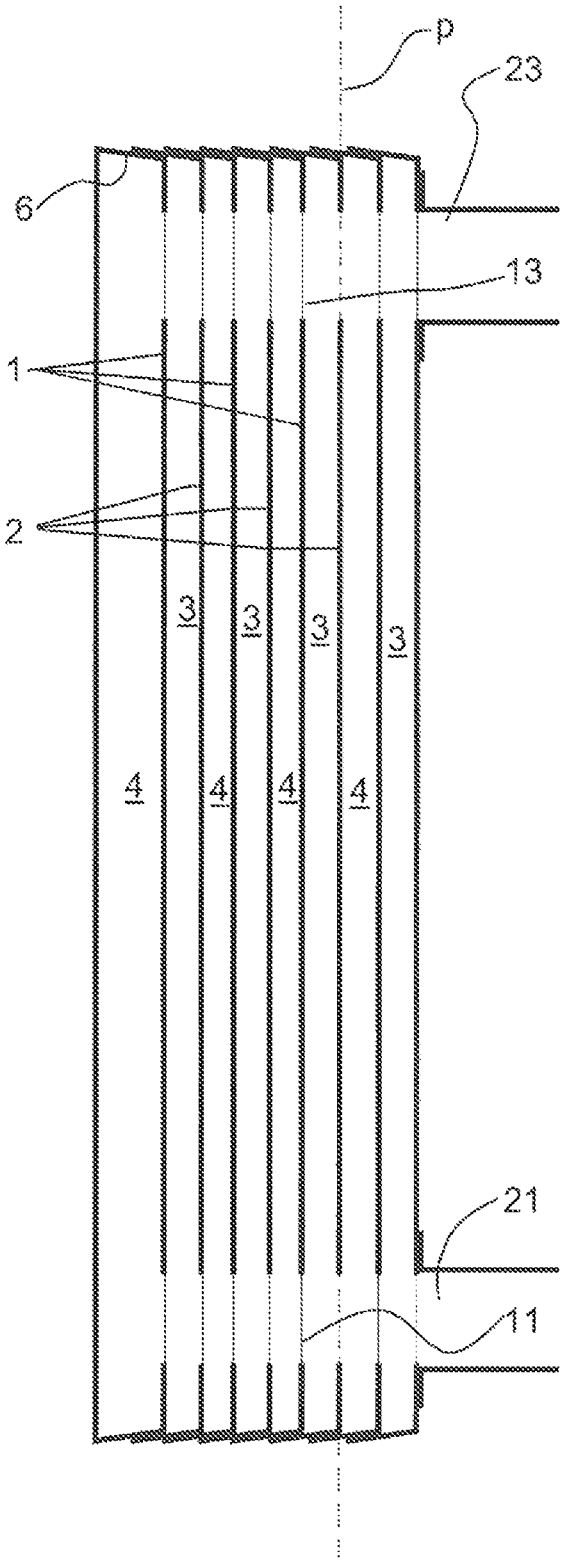
FIG. 2 discloses schematically a longitudinal sectional view along the line II-II in FIG. 1.

FIGS. 1 and 2 disclose a plate heat exchanger comprising a plurality of heat exchanger plates 1, 2. The heat exchanger plates 1, 2 comprise first heat exchanger plates 1 and second heat exchanger plates 2 arranged beside each other in an alternating order in the plate heat exchanger.

Each of the first heat exchanger plates 1 and the second heat exchanger plates 2 extends in parallel with an extension plane p.

The first and second heat exchanger plates 1, 2 are arranged side by side in such in a way that first plate interspaces 3 for a first fluid and second plate interspaces 4 for a second medium are formed.

The plate heat exchanger is configured to be operated as an evaporator, wherein the first plate interspaces 3 are configured to receive the first fluid to be evaporated therein. The first fluid may be any suitable refrigerant. The second plate interspaces 4 are configured to receive the second fluid for heating the first fluid to be evaporated in the first plate interspaces 3.

The plate heat exchanger may also be reversed, and is then configured to be operated as a condenser, wherein the first fluid, i.e. the refrigerant, is condensed in the first plate interspaces 3, and the second fluid is conveyed through the second plate interspaces 4 for cooling the first fluid conveyed through the first plate interspaces 3.

Figure 7:
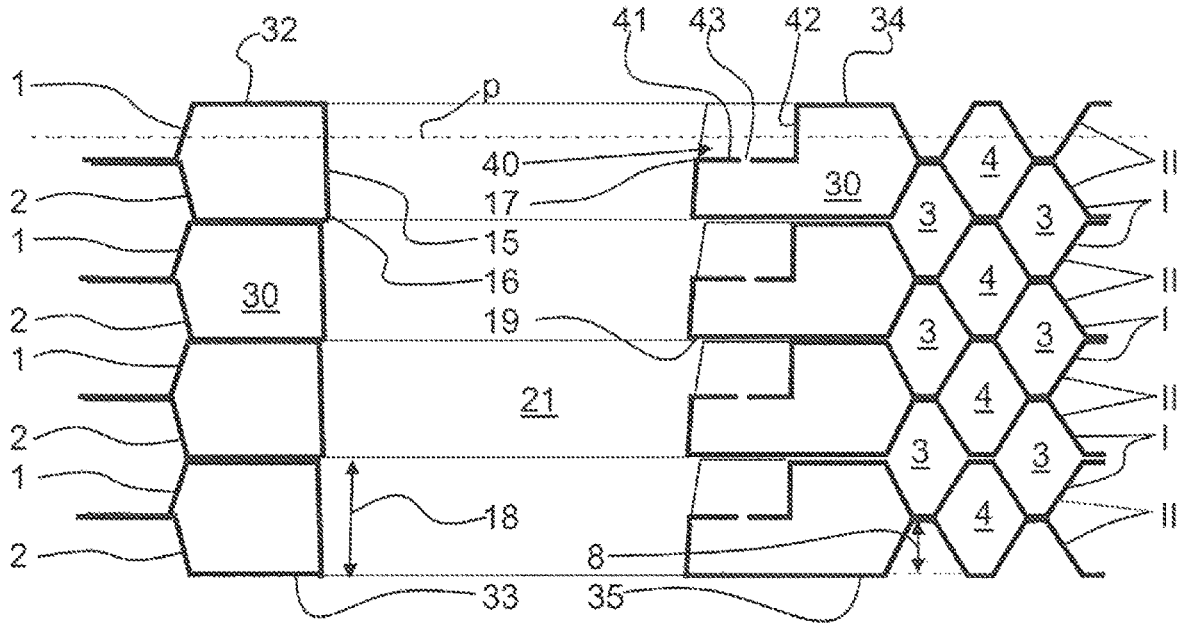
FIG. 7 discloses schematically a sectional view of the inlet channel area of some of the heat exchanger plates along the line VII-VII in FIG. 5.
Figure 8:
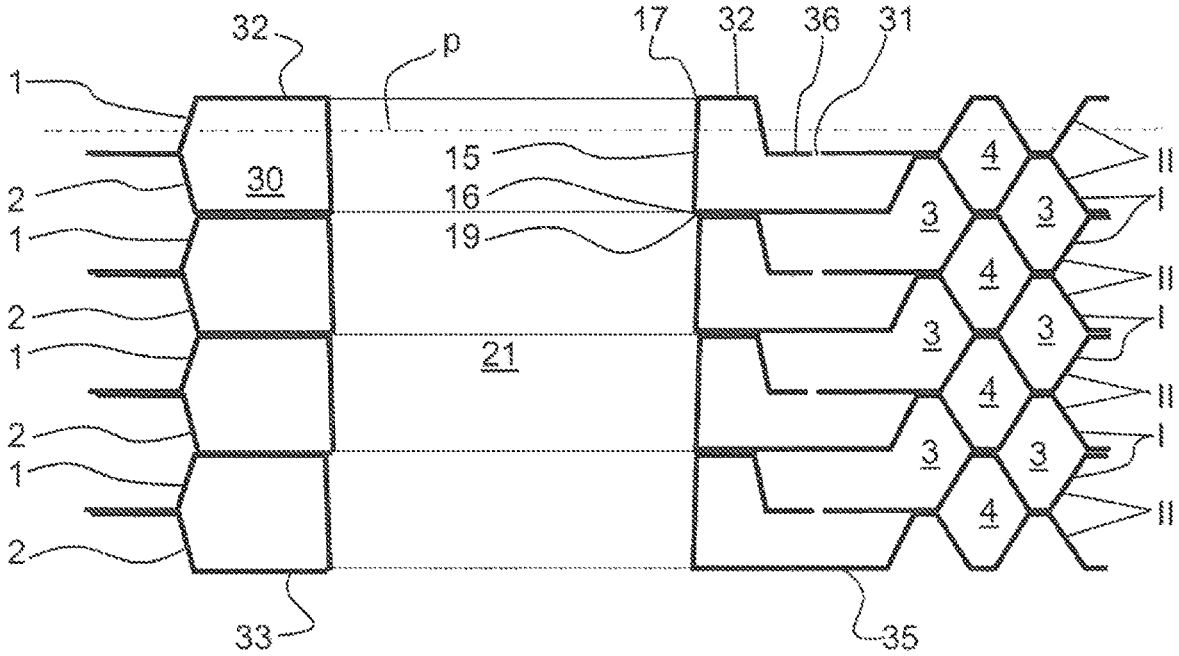
FIG. 8 discloses schematically a sectional view of the inlet channel area of some of the heat exchanger plates along the line VIII-VIII in FIG. 5.
Figure 9:
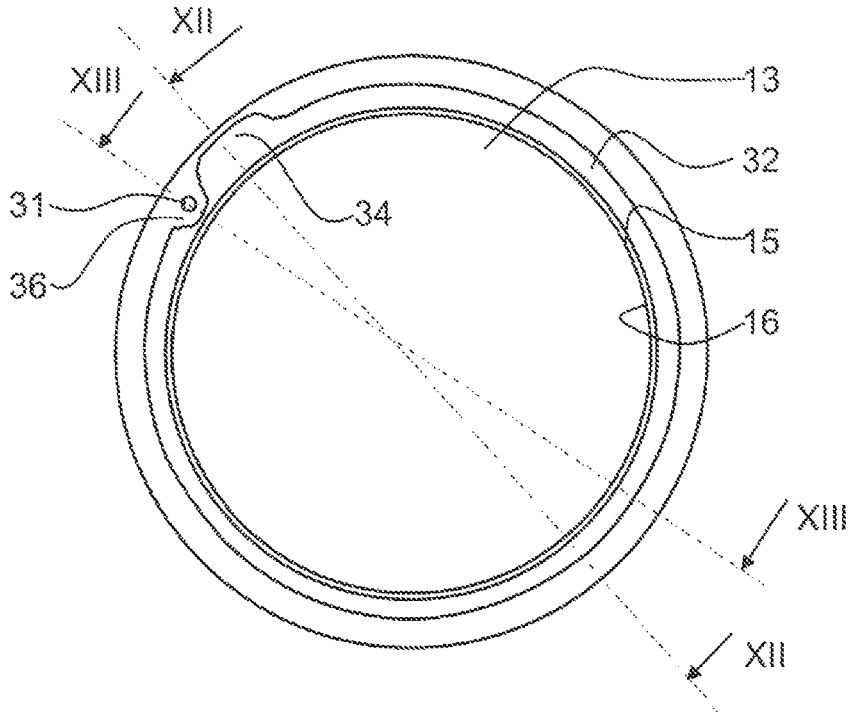
FIG. 9 discloses schematically a plan view of the inlet channel area of the first heat exchanger plate of a plate heat exchanger according to a second embodiment.
Figure 10:
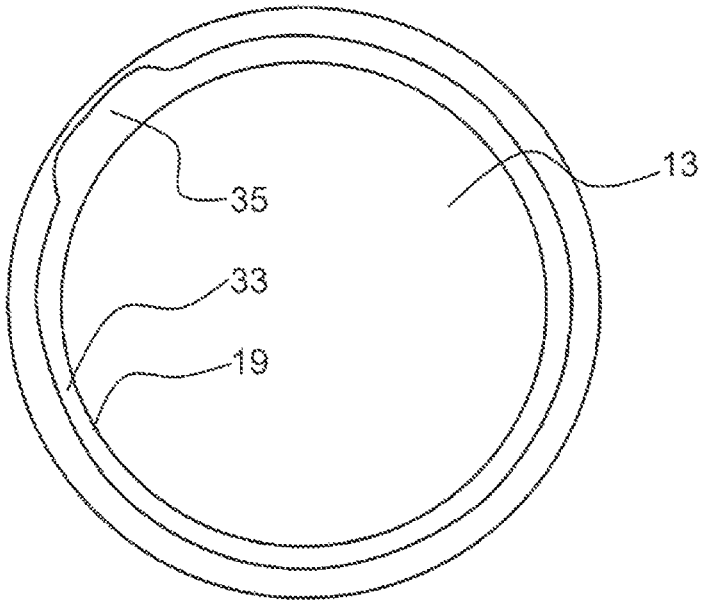
FIG. 10 discloses schematically a sectional view of an inlet channel area of the second heat exchanger plate.
Figure 11:
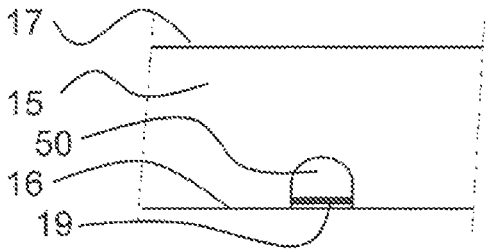
FIG. 11 discloses schematically a front view of a secondary pair of heat exchanger plates seen from the inlet channel in FIG. 9.

Each first plate interspace 3 is formed by a primary pair I, consisting of one of the second heat exchanger plates 2 and an adjacent one of the first heat exchanger plates 1, see FIGS. 7 and 8.

Each second plate interspace 4 is formed by a secondary pair II, consisting of one of the first heat exchanger plates 1 and an adjacent one of the second heat exchanger plates 2, see FIGS. 7 and 8.

The first plate interspaces 3 and the second plate interspaces 4 are provided side by side in an alternating order in the plate heat exchanger, as can be seen in FIG. 2.

Figure 3:
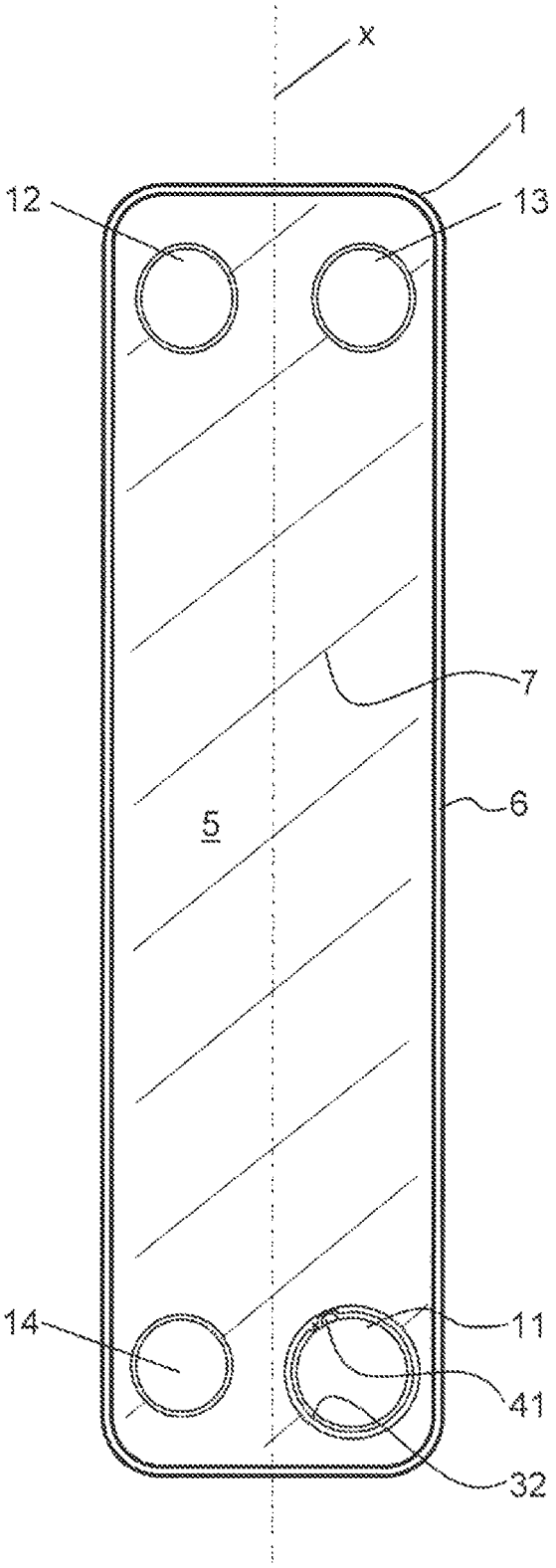
FIG. 3 discloses schematically a plan view of a first heat exchanger plate of the plate heat exchanger in FIG. 1.
Figure 4:
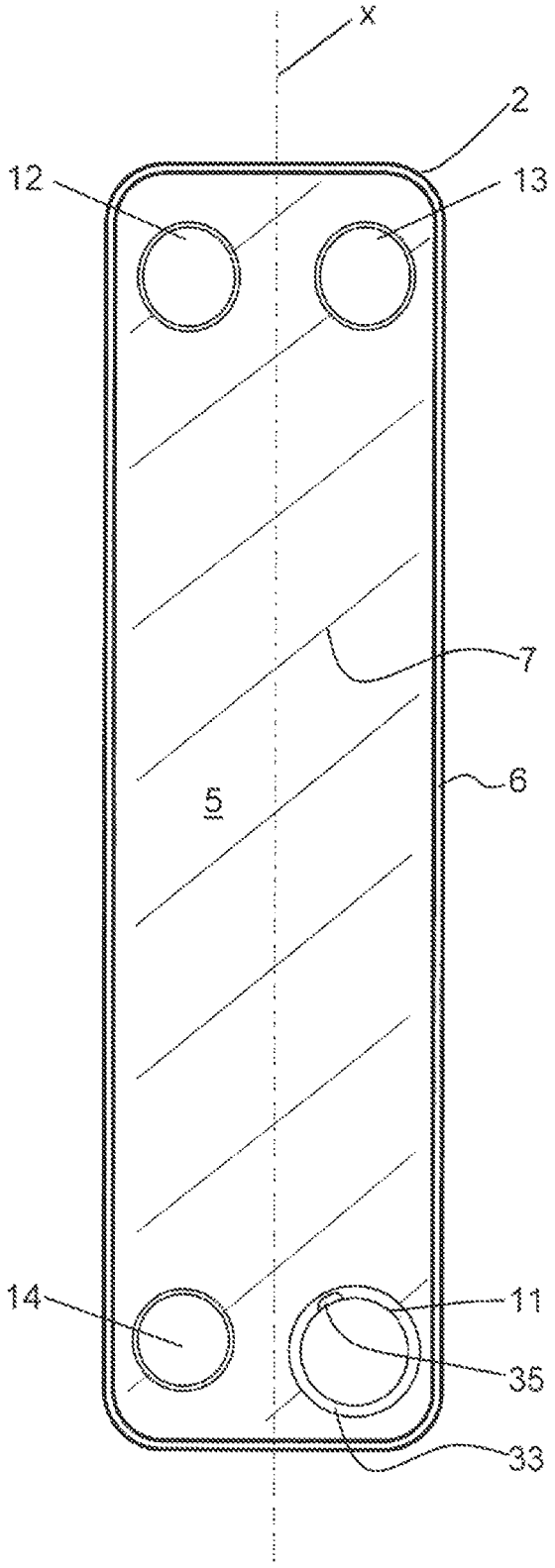
FIG. 4 discloses schematically a plan view of a second heat exchanger plate of the plate heat exchanger in FIG. 1.

Each first and second heat exchanger plate 1, 2 has a heat exchanger area 5, see FIGS. 3 and 4, extending in parallel with the extension plane p, and an edge area 6 extending around the heat exchanger area 5. The edge area 6 thus surrounds the heat exchanger area 5 and forms a flange, which is inclined in relation to the extension plane p, see FIG. 2. The flange of the edge area 6 of one of the heat exchanger plates 1, 2 adjoins, and is joined to the corresponding flange of the edge area 6 of an adjacent one of the heat exchanger plates 1, 2, in a manner known per se.

The heat exchanger area 5 comprises a corrugation 7 of ridges and valleys, which is schematically indicated in FIGS. 3 and 4, and in FIGS. 7 and 8. The corrugation 7 may form various patterns, for instance a diagonal pattern, a fish bone pattern, etc. as is known in the art of plate heat exchangers.

A pressure depth 8 is defined between an upper point of the ridges and a lower point of the valleys on an upper side of the respective first and second heat exchanger plates 1, 2, see FIG. 7. The pressure depth 8 is less than 3 mm, preferably less than 2 mm. The pressure depth may preferably be equal to or larger than 1 mm.

Each of the first heat exchanger plates 1 and the second heat exchanger plates 2 also comprises four port holes 11, 12, 13, 14.

A first port hole 11 of the port holes 11-14 of the first heat exchanger plates 1 is surrounded by a peripheral rim 15, see FIGS. 7 and 8. The peripheral rim 15 is annular and extends away from the heat exchanger area 5 transversally, or substantially transversally to the extension plane p.

The peripheral rim 15 has an edge 16 and a root end 17. The peripheral rim 15 has a rim height 18 perpendicular to the extension plane p from the edge 16 to the root end 17, see FIG. 7. The rim height 18 is larger than or slightly larger than twice the pressure depth 8.

As can be seen in FIGS. 7 and 8, the peripheral rim 15 is tapering or conical, or slightly tapering or conical, and tapers towards the edge 16, especially from the root end 17 to the edge 16.

The remaining three port holes 12-14 are not provided with such a peripheral rim, but are defined by a porthole edge, as schematically indicated in FIG. 2 for the portholes 13.

In the embodiments disclosed, the first port hole 11 of the second heat exchanger plates 2 also lacks the peripheral rim. The first port hole 11 of the second heat exchanger plates 2 is defined by a porthole edge 19, see FIGS. 7 and 8.

The first heat exchanger plates 1 and the second heat exchanger plates 2 are permanently joined to each other via joints of braze material, such as copper or a copper alloy, between the first and second heat exchanger plates 1, 2.

The first and second heat exchanger plates 1, 2 may be made of a metal or a metal alloy, such as stainless steel, which extends to the outer surface of the heat exchanger plate 1, 2. The outer surface of the metal or 5 metal alloy has such properties that it adheres to the braze material during the brazing of the plate heat exchanger.

The heat exchanger plates 1, 2 are arranged in such a way that the peripheral rim 15 of the first heat exchanger plates 1 define an inlet channel 21 extending through the plate heat exchanger, as can be seen in FIGS. 7 and 8. The peripheral rim 15 passes the adjacent second heat exchanger plate 2 before reaching the adjacent first heat exchanger plate 1. The edge 16 of the peripheral rim of the first heat exchanger plate 1 of one secondary pair II is thus joined to the root end 17 of the peripheral rim 15 of the first heat exchanger plate 1 of the adjacent secondary pair II.

The second port holes 12 of the heat exchanger plates 1, 2 define an outlet channel 22 for the first fluid, see FIGS. 1 and 2. The third port hole 13 of the heat exchanger plates 1, 2 define an inlet channel 23 for the second fluid. The fourth port hole 14 of the heat exchanger plates 1, 2 define an outlet channel 24 for the second fluid.

The peripheral rim 15 has a convex side, and an opposite concave side. The concave side of the peripheral rim 15 faces the inlet channel 21.

Each of the secondary pairs II encloses a respective inlet chamber 30 adjacent to the peripheral rim 15. The convex side of the peripheral rim 15 faces the inlet chamber 30.

Figure 5:
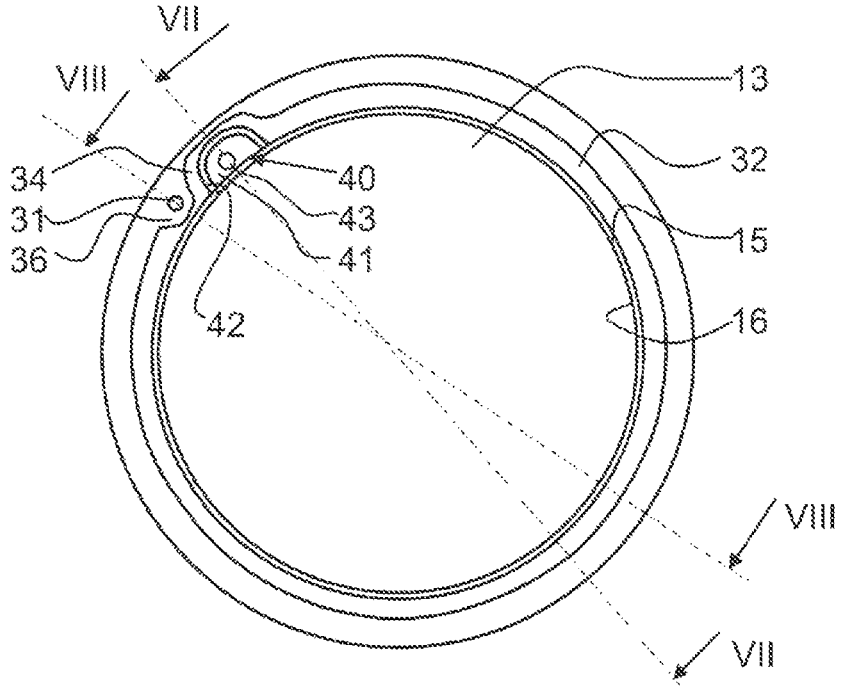
FIG. 5 discloses schematically a plan view of an inlet channel area of the first heat exchanger plate.

Each of the inlet chambers 30 is closed to the second plate interspaces 4, is open to the inlet channel 21 and communicates with one of the first plate interspaces 3 via a respective nozzle member 31, see FIGS. 5 and 8.

Each of the inlet chambers 30 is thus separated from or closed to the other inlet chambers 30 of the plate heat exchanger.

A flow of the first fluid from the inlet channel 21 to the first plate interspace 3 via the inlet chamber 30 is permitted.

The nozzle member 31 extends through the first heat exchanger plate 1 between the inlet chamber 30 and one of the first plate interspaces 3.

In the embodiments disclosed, the nozzle member 31 comprises or is formed by one restriction hole. It should be noted that the nozzle member 31 may comprise more than one restriction hole. The restriction hole provides a restriction or throttling of the first fluid passing through the nozzle member. Such restriction or throttling ensures a proper distribution of the first fluid in the first plate interspace.

The restriction hole, or more than one restriction holes, together have a flow area of 1.5-2.5 $mm^2$.

The restriction hole, or restriction holes, may be circular.

In the embodiments disclosed, the inlet chamber 30 surrounds the inlet channel 21. The inlet chamber 30 is thus annular.

Each of the first heat exchanger plates 1 comprises an annular flat portion 32 adjacent the peripheral rim 15. The annular flat portion 32 extends from the peripheral rim 15 in parallel with, or substantially in parallel with, the extension plane p.

Figure 6:
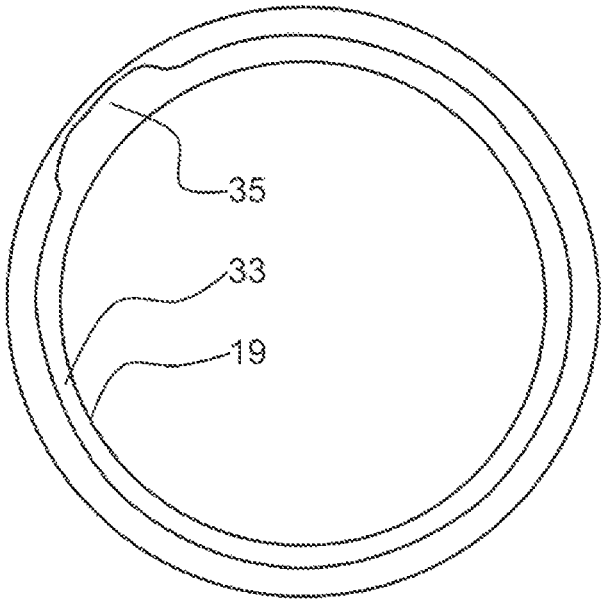
FIG. 6 discloses schematically a plan view of an inlet channel area of the second heat exchanger plate.

Each of the second heat exchanger plates 2 comprises a corresponding annular flat portion 33, which extends from the porthole edge 19 in parallel with, or substantially in parallel with the extension plane p, see FIG. 6.

The annular flat portion 32 and the corresponding annular flat portion 33 extend in parallel with each other and adjoins each other, see FIGS. 7 and 8. The annular flat portion 32, the peripheral rim 15, and the corresponding annular flat portion 33 enclose the inlet chamber 30.

As can be seen in FIG. 5, the annular flat portion 32 has a first projection 34 extending away from the peripheral rim 15 in parallel with the extension plane p. At the first projection 3, the annular flat portion 32 is wider.

As can be seen in FIG. 6, the corresponding annular flat portion 33 has a second projection 35. At the second projection 35, the corresponding annular flat portion 33 is wider, and thus extends further from the porthole edge 19. The second projection 35 has a longer peripheral length than the first projection 34.

Beside the first projection 34, the first heat exchanger plate 1 of each secondary pair II has a flat area 36, see FIG. 5, which extends in parallel with the extension plane p, see FIG. 8.

The flat area 36 is located adjacent to a concave part of the plate annular flat portion 32 and extend towards the peripheral rim 15.

The first projection 34 and the flat area 36 are located opposite to the second projection 35. The nozzle member 31 extends through the flat area 36 as can be seen in FIGS. 5 and 7.

It should be noted that the annular chamber 30 alternatively may extend only along a part of the circumference of the inlet channel 21. For instance, the inlet chamber 30 may have a circumferential length corresponding to the length of the second projection 35.

In the first embodiment, the peripheral rim 15 of the first heat exchanger plate 1 of the secondary pairs II comprises a depression 40, which forms a surface portion 41 that extends away from the inlet channel 21, see FIGS. 3, 5 and 7. The depression 40 extends from the annular flat portion 32 and from the peripheral rim 15. The surface portion 41 is partly surrounded by a wall surface 42, which extends between and connects to the surface portion 41 and the annular flat portion 32.

The surface portion 41 is substantially plane and extends substantially in parallel with the extension plane p.

In the first embodiment, the inlet chamber 30, is open to the inlet channel 21 via an aperture 43, see FIGS. 5 and 7. The aperture 43 extends through the surface portion 41 and permits a flow of the first fluid from the inlet channel 21 to the first plate interspace 3 via the inlet chamber 30.

Although only one aperture 43 is disclosed in the first embodiment, it should be noted that more than one apertures 43 may be provided. The aperture 43, or apertures, have a total flow area that is larger than the flow area of the nozzle member 31, in particular larger than the total flow area of the one or more restriction holes of the nozzle member 31.

The second embodiment, see FIGS. 9 to 13, differs from the first embodiment in how the inlet channel 21 is open to the inlet chamber 30. It should be noted that the same reference signs has been used in the different embodiments for corresponding elements.

In the second embodiment, the peripheral rim 15 of the first heat exchanger plate 1 of the secondary pairs II comprises a recess 50. The recess 50 is open towards and extends from the edge 16 of the peripheral rim 15, see in particular FIGS. 11 and 12.

In the second embodiment, the inlet chamber 30, is thus open to the inlet channel 21 via the recess 50, which permits a flow of the first fluid from the inlet channel 21 to the first plate interspace 3 via the inlet chamber 30 and the nozzle member 31, which extends through the flat area 36 of the first heat exchanger plate 1.

Figure 12:
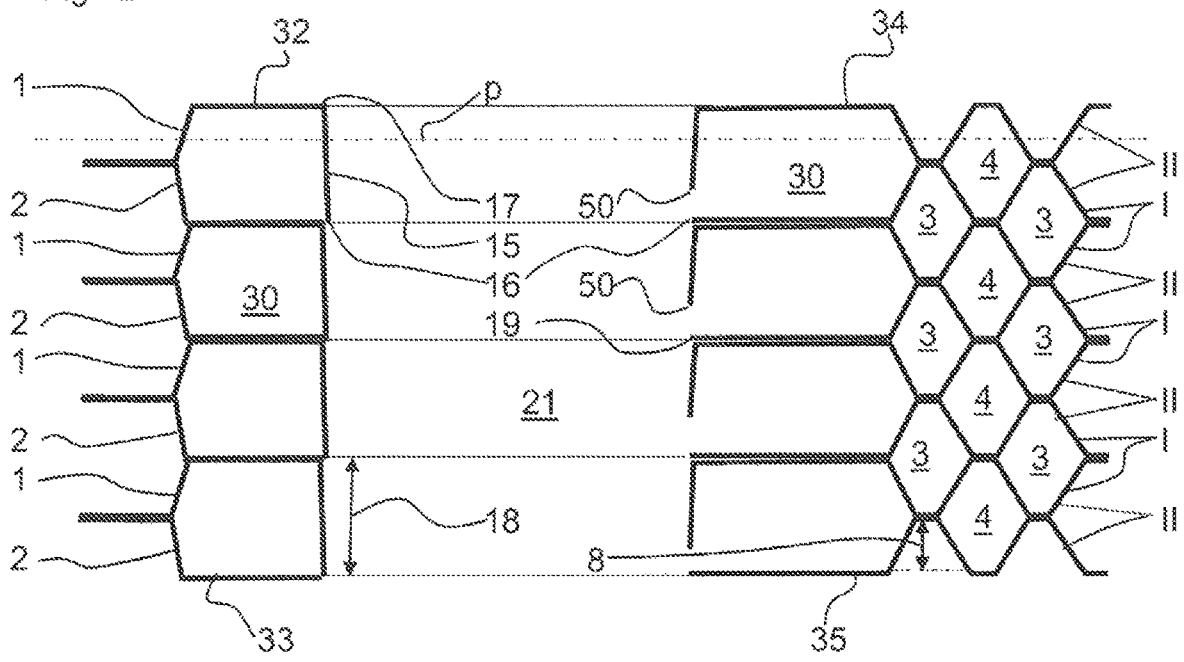
FIG. 12 discloses schematically a sectional view of the inlet channel area of some of the heat exchanger plates along the line XII-XII in FIG. 9.
Figure 13:
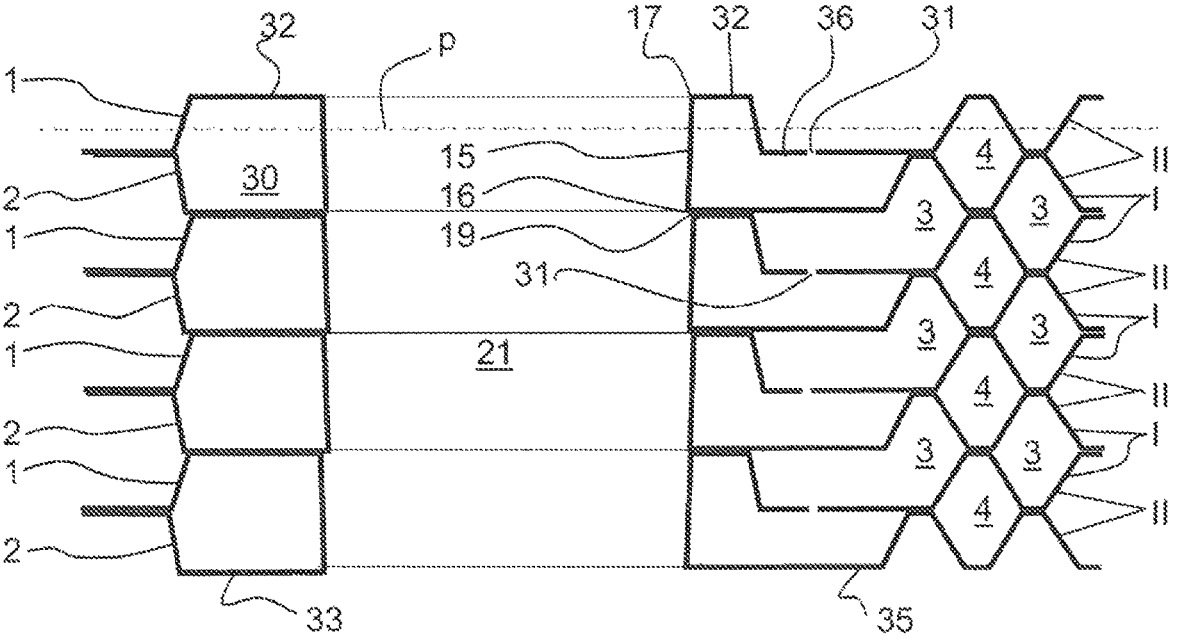
FIG. 13 discloses schematically a sectional view of the inlet channel area of some of the heat exchanger plates along the line XIII-XIII in FIG. 10.

The recess 50 is located opposite to the first projection 34 of the annular flat portion 32, as can be seen in FIG. 12.

Although only one recess 50 is disclosed in the second embodiment, it should be noted that more than one recesses 50 may be provided. The recess 50, or recesses, have a total flow area that is larger than the flow area of the nozzle member 31, in particular larger than the total flow area of the one or more restriction holes of the nozzle member 31.

In the second embodiment, peripheral rim 15 has no depression forming a surface portion.

The invention is not limited to the embodiments disclosed, but may be varied and modified within the scope of the following claims.

The invention claimed is:

1. A plate heat exchanger for evaporation, comprising first heat exchanger plates and second heat exchanger plates arranged beside each other in an alternating order, first plate interspaces for a first fluid to be evaporated, each first plate interspace being formed by a primary pair consisting of one of the second heat exchanger plates and an adjacent one of the first heat exchanger plates, and second plate interspaces for a second fluid, each second plate interspace being formed by a secondary pair consisting of one of the first heat exchanger plates and an adjacent one of the second heat exchanger plates, wherein the first and second plate interspaces are arranged beside each other in an alternating order, wherein each of the first heat exchanger plates and the second heat exchanger plates extends in parallel with an extension plane and comprises a number of portholes, wherein each of the first heat exchanger plates comprises a peripheral rim surrounding a first porthole of said number of portholes and extending transversely to the extension plane, wherein the peripheral rim of one of the first heat exchanger plates extends to an adjacent one of the first heat exchanger plates so that the peripheral rims define an inlet channel for the first fluid through the plate heat exchanger, wherein each of the secondary pairs encloses an inlet chamber adjacent to the peripheral rim, the inlet chamber being closed to the second plate interspaces, the inlet chamber being open to the inlet channel and communicating with one of the first plate interspaces via a nozzle member, comprising at least one restriction hole, thereby permitting a flow of the first fluid from the inlet channel to the first plate interspace.

2. The plate heat exchanger according to claim 1, wherein the nozzle member extends through the first heat exchanger plate between the inlet chamber and said one of the first plate interspaces.

3. The plate heat exchanger according to claim 1, wherein the at least one restriction hole has a flow area of 1.5-2.5 $mm^2$.

4. The plate heat exchanger according to claim 1, wherein the inlet chamber surrounds the inlet channel.

5. The heat exchanger according to claim 4, wherein each of the first heat exchanger plates comprises an annular flat portion adjacent the peripheral rim.

6. The plate heat exchanger according to claim 5, wherein the annular flat portion extends substantially in parallel with the extension plane.

7. The heat exchanger according to claim 1, wherein the peripheral rim of the first heat exchanger plate of the secondary pairs comprises a depression forming a surface portion extending away from the inlet channel, and wherein an aperture extends through the surface portion and permits said flow of the first fluid from the inlet channel to the first plate interspace.

8. The plate heat exchanger according to claim 7, wherein the depression extends from the annular flat portion and from the peripheral rim.

9. The plate heat exchanger according to claim 8, wherein the surface portion is partly surrounded by a wall surface, which extends between and connects to the surface portion and the annular flat portion.

10. The plate heat exchanger according to claim 7, wherein the surface portion is substantially plane.

11. The plate heat exchanger according to claim 7, wherein the surface portion extends substantially in parallel with the extension plane.

12. The plate heat exchanger according to claim 1, wherein the peripheral rim of the first heat exchanger plate of the secondary pairs comprises a recess extending from an edge of the peripheral rim, and permitting said flow of the first fluid from the inlet channel to the first plate interspaces.

13. The plate heat exchanger according to claim 1, wherein the peripheral rim has a rim height perpendicular to the extension plane from an edge to a root end of the peripheral rim, and wherein the peripheral rim passes the adjacent second heat exchanger plate before reaching the adjacent first heat exchanger plate.

14. The plate heat exchanger according to claim 1, wherein each of the first and second heat exchanger plates has a heat exchanger area comprising a corrugation of ridges and valleys, and wherein a pressure depth is defined between an upper point of the ridges and a lower point of the valleys on an upper side of the respective first and second heat exchanger plates.

15. The plate heat exchange according to claim 14, wherein the pressure depth is less than 3 mm.

16. A plate heat exchanger for evaporation comprising:

first heat exchanger plates and second heat exchanger plates arranged beside each other in an alternating order, each of the first heat exchanger plates and each of the second heat exchanger plates including a heat exchanger area comprising a corrugation of ridges and valleys;

first plate interspaces for a first fluid to be evaporated, each first plate interspace being formed by a primary pair consisting of one of the second heat exchanger plates and an adjacent one of the first heat exchanger plates;

second plate interspaces for a second fluid, each second plate interspace being formed by a secondary pair consisting of one of the first heat exchanger plates and an adjacent one of the second heat exchanger plates;

the first and second plate interspaces being arranged beside each other in an alternating order;

each of the first heat exchanger plates and the second heat exchanger plates extending parallel with an extension plane and comprises a number of portholes;

each of the first heat exchanger plates that includes the heat exchanger area comprising the corrugation of ridges and valleys comprising a peripheral rim surrounding a first porthole of said number of portholes and extending transversely to the extension plane;

the peripheral rim of one of the first heat exchanger plates extending to an adjacent one of the first heat exchanger plates so that the peripheral rims define an inlet channel for the first fluid through the plate heat exchanger; and each of the secondary pairs enclosing an inlet chamber adjacent to the peripheral rim, the inlet chamber being closed to the second plate interspaces, the inlet chamber being open to the inlet channel and communicating with one of the first plate interspaces via a nozzle member comprised of at least one restriction hole, thereby permitting a flow of the first fluid from the inlet channel to the first plate interspace.

17. The plate heat exchanger according to claim 16, wherein each of the first heat exchanger plates that includes the heat exchanger area comprising the corrugation of ridges and valleys is devoid of a peripheral rim surrounding a second porthole of said number of portholes.

18. A plate heat exchanger for evaporation comprising:

first heat exchanger plates and second heat exchanger plates arranged beside each other in an alternating order, each of the first heat exchanger plates and each of the second heat exchanger plates including a heat exchanger area comprising a corrugation of ridges and valleys;

first plate interspaces for a first fluid to be evaporated, each first plate interspace being formed by a primary pair consisting of one of the second heat exchanger plates and an adjacent one of the first heat exchanger plates;

second plate interspaces for a second fluid, each second plate interspace being formed by a secondary pair consisting of one of the first heat exchanger plates and an adjacent one of the second heat exchanger plates;

the first and second plate interspaces being arranged beside each other in an alternating order;

each of the first heat exchanger plates and the second heat exchanger plates extending parallel with an extension plane and comprises a number of portholes;

each of the first heat exchanger plates that includes the heat exchanger area comprising the corrugation of ridges and valleys comprising a peripheral rim surrounding a first porthole of said number of portholes and extending transversely to the extension plane;

the peripheral rim of one of the first heat exchanger plates passing an adjacent one of the second heat exchanger plates and extending to an adjacent one of the first heat exchanger plates so that the peripheral rims define an inlet channel for the first fluid through the plate heat exchanger; and each of the secondary pairs enclosing an inlet chamber adjacent to the peripheral rim, the inlet chamber being closed to the second plate interspaces, the inlet chamber being open to the inlet channel and communicating with one of the first plate interspaces via a nozzle member comprised of at least one restriction hole, thereby permitting a flow of the first fluid from the inlet channel to the first plate interspace.

19. The plate heat exchanger according to claim 18, wherein each of the first heat exchanger plates that includes the heat exchanger area comprising the corrugation of ridges and valleys is devoid of a peripheral rim surrounding a second porthole of said number of portholes.

* * * * *